US005215197A

United States Patent [19]

Harvey

[11] Patent Number: 5,215,197

[45] Date of Patent: Jun. 1, 1993

[54] SEAFOOD SEPARATOR DEVICE

[76] Inventor: James A. Harvey, P.O. Box 113, St. Francisville, La. 70775

[21] Appl. No.: 836,247

[22] Filed: Feb. 18, 1992

[51] Int. Cl.[5] ..... B07B 1/04; B07B 1/40

[52] U.S. Cl. ..... 209/680; 209/235; 209/255; 209/317; 209/355; 209/413; 209/421

[58] Field of Search ..... 209/680, 660, 315, 317, 209/353, 355, 408, 412, 413, 409, 420, 935, 235, 255, 319, 906, 243, 421; 43/6.5, 8

[56] References Cited

U.S. PATENT DOCUMENTS

| | | | |
|---|---|---|---|
| 1,154,501 | 9/1915 | Foster . | |
| 2,948,980 | 8/1960 | Worchester | 43/9.1 |
| 3,315,807 | 4/1967 | Rosen | 209/355 |
| 3,440,752 | 4/1969 | Minter | 32/9.2 |
| 3,744,631 | 7/1973 | Smith et al. | 209/319 |
| 3,750,233 | 8/1973 | Lovett | 209/3 |
| 3,784,007 | 1/1974 | Skrmetta | 209/682 X |
| 4,043,068 | 8/1977 | Savole | 43/9 |
| 4,171,747 | 10/1979 | Metzger et al. | 209/666 X |
| 4,323,160 | 4/1982 | Cowgill | 209/235 X |
| 4,402,154 | 9/1983 | Pence | 43/9 |
| 4,739,574 | 4/1988 | Saunders | 43/9 |
| 4,765,886 | 8/1988 | Whitaker | 209/235 X |
| 4,790,439 | 12/1988 | McIntyre et al. | 209/668 X |
| 4,805,335 | 2/1989 | West et al. | 43/9 |
| 4,852,295 | 8/1989 | Sandlofer | 43/100 |
| 4,869,010 | 9/1989 | Saunders, Sr. | 43/9.2 |
| 4,944,108 | 7/1990 | George et al. | 43/6.5 |

FOREIGN PATENT DOCUMENTS

| | | | |
|---|---|---|---|
| 535858 | 4/1922 | France | 209/355 |
| 487622 | 9/1973 | U.S.S.R. | 43/6.5 |

*Primary Examiner*—Donald T. Hajec

*Attorney, Agent, or Firm*—William David Kiesel; Robert C. Tucker; Warner J. Delaune, Jr.

[57] ABSTRACT

A seafood separator for separating sea creatures captured by a net is provided, comprising a support structure attached to the deck of a boat; a number of vertically arranged frames attached to the support structure, each frame containing a screen for retaining sea creatures of predetermined sizes, wherein the grid spacing of each screen is smaller than the grid spacing of any higher screen. Each screen is capable of slidable motion relative to the support structure or to any other screen in order to facilitate cleaning and seafood removal. A tray for collecting trash and unwanted seafood is attached to the support structure below a lowermost screen and has an end positioned over the boat deck to allow return of the trash back into the sea. A method for separating sea creatures and returning undesirable sea creatures back to the sea alive is also provided.

9 Claims, 3 Drawing Sheets

SEAFOOD SEPARATOR DEVICE

BACKGROUND OF THE INVENTION

I. Field of the Invention

The present invention relates generally to devices for separating seafood of various sizes, and more particularly for separating desired seafood products from unwanted seafood products caught in a net.

II. Description of Prior Art

In commercial as well as recreational fishing which involves the use of large nets, fisherman have always looked for ways of separating the seafood products they desire (mainly shrimp) from those for which they have no use. Given the myriad of sea products retrievable in any one catch, the separating process can take long periods of time while workers divide the desired shrimp or fish from any entrained vegetation or miscellaneous sea life. While some separation can be achieved through a host of devices designed specifically for use with a trawl net during the trawling process, the separating techniques used on the boat itself or on wharves once the boat has reached shore are often times primitive.

Many times, boats will simply empty their catches onto a wharf once they have reached shore, whereupon workers will sift through the catch removing those fish and shrimp that are to be kept. This method promotes premature decomposition of the seafood, invites contamination, and results in pervasive odors in and around the wharf. Another typical separating technique known in the fishing business is the use of a large table having an inclined surface and at least two raised sides to prevent escape of wandering seafood, such as crabs. The upper end of the table is open to allow upward-climbing crabs to leave the table and fall into a waiting container, thus making it easier to pick out the shrimp from the catch. While this device is simple, it is generally very large and hence unsuitable for use on most boat decks. Moreover, it requires much use of manual labor to segregate the seafood, and offers no means of classifying different size seafood into industry-accepted classes.

Another, and perhaps more pervasive, problem with current methods of collecting seafood from nets is that most of the unwanted products are killed in the process of retrieving the desired catch. For example, another common method of separating shrimp from other seafood is to empty the net contents into a vat filled with highly concentrated brine. Exposure to the brine causes the fish, crabs, and other animals to die and rise to the surface of the liquid while the shrimp sink to the bottom. Therefore, once the shrimp are collected, the undesired seafood products are simply wasted rather than returned alive.

The unnecessary killing of unwanted seafood is also the result of attempts to clean the contents of the net prior to dumping the catch into the boat. In many cases, a net filled with a combination of seafood, plant debris and mud will be hoisted from the water and suspended over the deck of the boat. At a point just above the contents of the net, the net will be constricted and tightly tied in order to completely restrict the motion of the seafood within the net, thereby preventing seafood from escaping through the net. Thereafter, this filled portion of the net is placed back into the water and dragged below the surface for some time until most of the mud and debris are washed therefrom. Any crabs and fish caught in the net are thus killed during the washing process, because they are unable to move and circulate oxygenated water into their gill systems.

Most importantly, however, endangered marine turtles which may have also been captured are also killed during the washing process described above. The killing of these turtles has prompted, among other things, federal regulations (37 C.F.R. §§227.71–227.72) which require certain fishing vessels to incorporate so-called "turtle excluder devices" or "TED's" which allow these turtles to escape the nets prior to retrieval of the net from the water. These regulations have been met with strong resistance from fishermen, primarily because use of the TED's reduces their catch when desired seafood escapes with the turtles, and because the regulations limit the allowable tow time of the trawl. Consequently, any device which would accomplish the live return of turtles and other unwanted seafood into the sea, and thus reduce or eliminate the need for these TED's, would be met with instant and widespread acceptance in the fishing industry.

What is needed, therefore, is a seafood separator device which is still simple to maintain and use, but which includes the ability to quickly separate fish and shrimp into size groups for later processing. In addition, such a device is needed for actual use on the deck of a boat while the boat is at sea so that unwanted sea products may be returned to the sea alive, rather than killed during the cleaning and sorting process. The environmental advantages of returning seafood to the sea alive are that populations of endangered or other non-consumable animals are left intact, and seafood too small to be commercially acceptable are allowed to grow until they may be harvested at a later time. It would also be advantageous to have a device which would allow quick return of the net back into the sea for further trawling without the need to "drag clean" the contents or to modify existing nets for use with turtle excluder devices.

SUMMARY OF THE INVENTION

It is therefore an object of this invention to provide a seafood separator device which minimizes the manual labor required to differentiate between seafood of varying sizes.

It is also an object of this invention to provide a seafood separator device which can easily be used on the deck of a boat.

Yet another object of this invention is to provide a seafood separator device which includes a means for removing fish, crabs, turtles or other unwanted seafood and returning them to the sea alive.

It is a further object of this invention to provide a seafood separator device which simple and easy to maintain.

Still another object of this invention is to provide a seafood separator device which will eliminate the use of so-called turtle excluder devices, or "TED's".

A further object of this invention is to provide a seafood separator device which will allow a trawl net to be emptied and returned to the sea more quickly and frequently than has previously been possible in the fishing industry.

These and other objects and advantages of the present invention will no doubt become apparent to those skilled in the art after having read the following description of the preferred and alternate embodiments which are contained in and illustrated by the various drawing figures.

Therefore, in a preferred embodiment, a seafood separator device for separating sea creatures by a net is provided, comprising a support structure attached to the deck of a boat; a plurality of substantially horizontal screening means arranged in a vertical array and operatively attached to said support structure for retaining sea creatures of predetermined sizes, wherein each said screening means includes a grid spacing and wherein the grid spacing of any said screening means is smaller than the grid spacing of any higher said screening means; each said screening means further comprising moving means operatively disposed between said support structure and said screening means for allowing slidable motion of said screening means relative to said support structure or to any other said screening means; and trash discarding means operatively attached to said support structure below a lowermost said screening means for receiving unwanted sea products passing through said array and directing said sea products back into the sea alive.

DETAILED DESCRIPTION OF THE PREFERRED EMBODIMENTS

Figure 2:
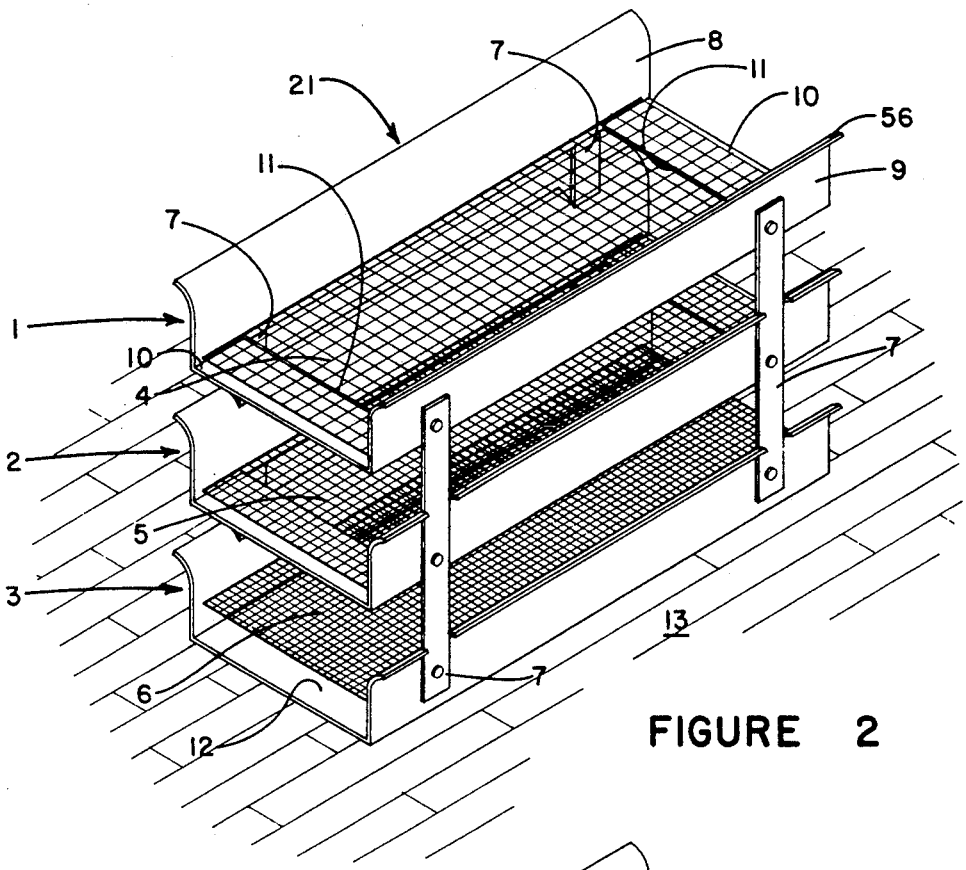
FIG. 2 is a view of one embodiment of a seafood separator device having nonmovable screens.

Referring more particularly to the drawings, FIG. 2 depicts one embodiment of a seafood separator device for use on the deck of a boat. The device comprises a series of three vertically arranged frames 1, 2, 3 each containing a screen 4, 5, 6, kept in place by four vertical rigid members 7. Each screen 4, 5, 6 is formed with a different rectangular grid spacing produced by the weave of the wire composing each screen 4, 5, 6 such that the grid spacing of the upper screen 4 is larger than the grid spacing of the intermediate screen 5. Similarly, the grid spacing of the intermediate screen 5 is larger than the grid spacing of the lower screen 6. Preferably, upper screen 4 has a grid spacing which is no larger than the mesh of net 51, which is necessary for retaining larger sea creatures such as turtles and large fish. The grid spacings of intermediate screen 5 and lower screen 6 are dependent upon the needs of the particular fisherman. As an example, the inventor has determined that 70–80 count shrimp (70–80 shrimp per pound) will typically be retained on a screen having a grid spacing of about ½ inch.

Still referring to FIG. 2, upper and intermediate frames 1, 2 each contain a pair of elongated parallel sections 8, 9 fixedly held in position with respect to each other at each end by a transverse section 10 connecting parallel sections 8, 9 by either bolting, nailing, bracketing or any other common method. Parallel sections 8, 9 also contain flared sides 55, 56 which help the laborer in removing seafood from frames 1, 2, 3. It is important that the inside edges 11 of both transverse sections 10 do not extend beneath the screens 4, 5 so as to obstruct the downward path of objects falling through the grid spacing of the screens 4, 5 onto the next level. Lower frame 3 also contains parallel sections 8, 9 with flared sides 55, 56, but includes bottom 12 fixedly attached to parallel sections 8, 9 by bolting or nailing in order to collect water and unwanted live sea products (regarded as "trash") passing through lower screen 6 for subsequent return to the sea. All frames 1, 2, 3 are held in position with respect to each other by attachment of the four rigid members 7 either by nailing, bolting or any other common method which would be sufficient to impart overall structural rigidity to the device. The separator device is attached to the deck 13 of the boat by bolting or any other conventional method common in the art with the lower frame 3 being positioned so that one end of frames 1, 2, 3 extends over the surface of the sea so that unwanted trash may be dumped back into the water as shown in FIG. 1.

Figure 3:
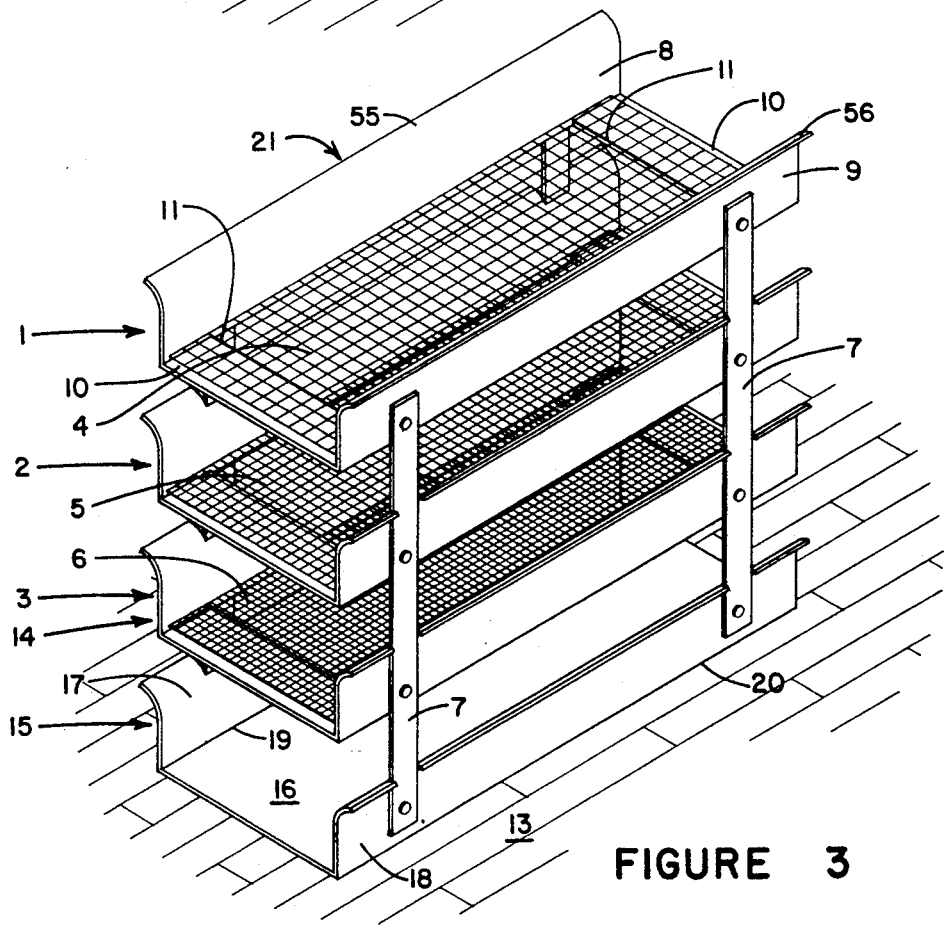
FIG. 3 is a view of an alternate embodiment of the invention comprising a trash tray separate from the screening portion of the device.

An alternate configuration shown in FIG. 3 includes modified lower frame 14 and screen 6 to be constructed identically to both upper and intermediate screens 4, 5 and frames 1, 2, except for the differences in grid spacing among the three screens 4, 5, 6. In such an embodiment, a separate trash tray 15 may be included below modified lower frame 14 and simply comprises a tray bottom 16 and two parallel sides 17, 18 attached along the lengthwise edges 19, 20 of tray bottom 16 to form a trough. Trash tray 15 is positioned so that one end extends over the surface of the sea, as shown in FIG. 1 used in an embodiment to be described below, and may be inclined to facilitate emptying of trash by spraying water therethrough.

In either of the above embodiments, each screen 4, 5, 6 is attached to its respective frame 1, 2, 3, 14 by welding or any other common method known in the art, depending on the materials used in the construction of the device, in such a manner that the tension in each screen 4, 5, 6 is sufficient to prevent sagging of screens 4, 5, 6 under the weight of objects supported by the screens 4, 5, 6. In this respect, it is preferred that a strong wire material, such as stainless steel, be used for the screens 4, 5, 6 which is stiff enough to retain its shape under the weight of the supported objects. Typically, stainless steel wire of about 1/16 inch diameter is effective in satisfying these requirements. Additionally, screens 4, 5, 6 should be attached between parallel sections 8, 9 such that top edges 21 of flared sides 55, 56 of parallel sections 8, 9 extend about 12 inches above screen 4, 5, 6 in order to prevent lively fish and shrimp from escaping the device. In all cases, screens 4, 5, 6 should be composed of a material which is resistant to the corrosive effects of sea water, such as aluminum or stainless steel.

Figure 1:
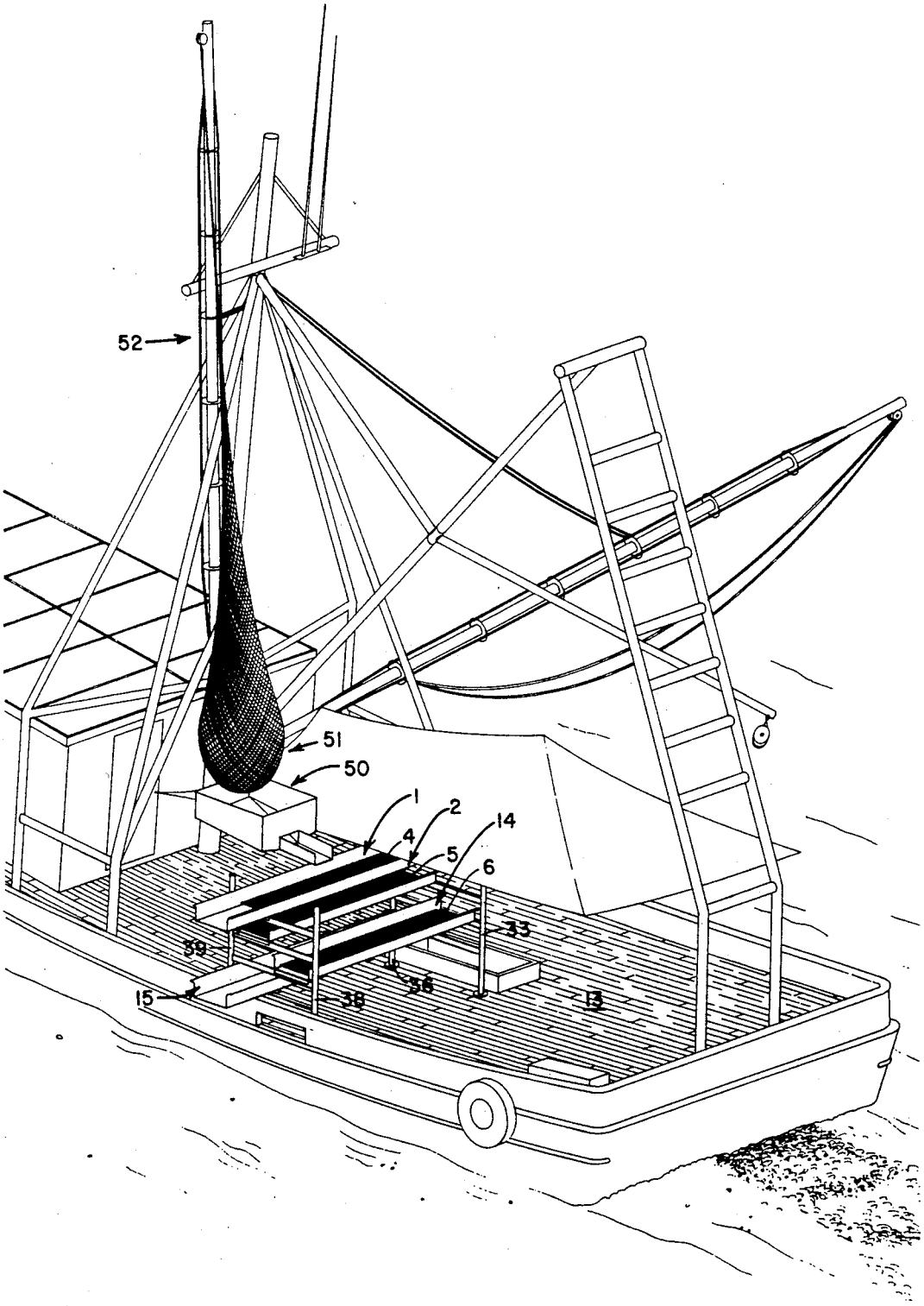
FIG. 1 is a view of the stern of a boat showing a preferred embodiment of the present invention in operation.

In operation of the first embodiment, sea products captured in a net 51 are moved by way of a hoist and boom assembly 52 over an optional hopper 50 and are immediately dumped into hopper 50, shown in FIG. 1. The sea products are then gradually emptied from hopper 50 onto upper screen 4 and a porous fabric (not shown) is lightly placed over upper frame 1 to prevent the seafood from jumping out of upper frame 1. It is to be understood that if no hopper 50 is employed, that the device must be of a volume large enough to accommodate the entire contents of the net. Water is then sprayed onto the upper screen 4 to clean and facilitate the movement of seafood and other objects down to intermediate screen 5. The seafood remaining in the upper screen 4 are then removed and stored separately for later processing if it is desired that they be kept. If upper screen 4 is to be used for retaining unwanted larger fish and turtles, those animals are quickly and simply pushed over the side of the boat back into the sea alive. The above process is repeated for both the intermediate screen 5 and lower screen 6 until fish and shrimp too small to be retained by any screen 4, 5, 6 have fallen through to the bottom 12 of lower frame 3. Small fish and shrimp in the bottom 12 of lower frame 3 of this embodiment are then returned to the sea alive by spraying water into lower frame 3 and urging them out of lower frame 3. A similar procedure is employed to clean out the trash tray 15 of the alternate embodiment after the contents of the net 51 have travelled through all three screens 4, 5, 6.

Figure 4:
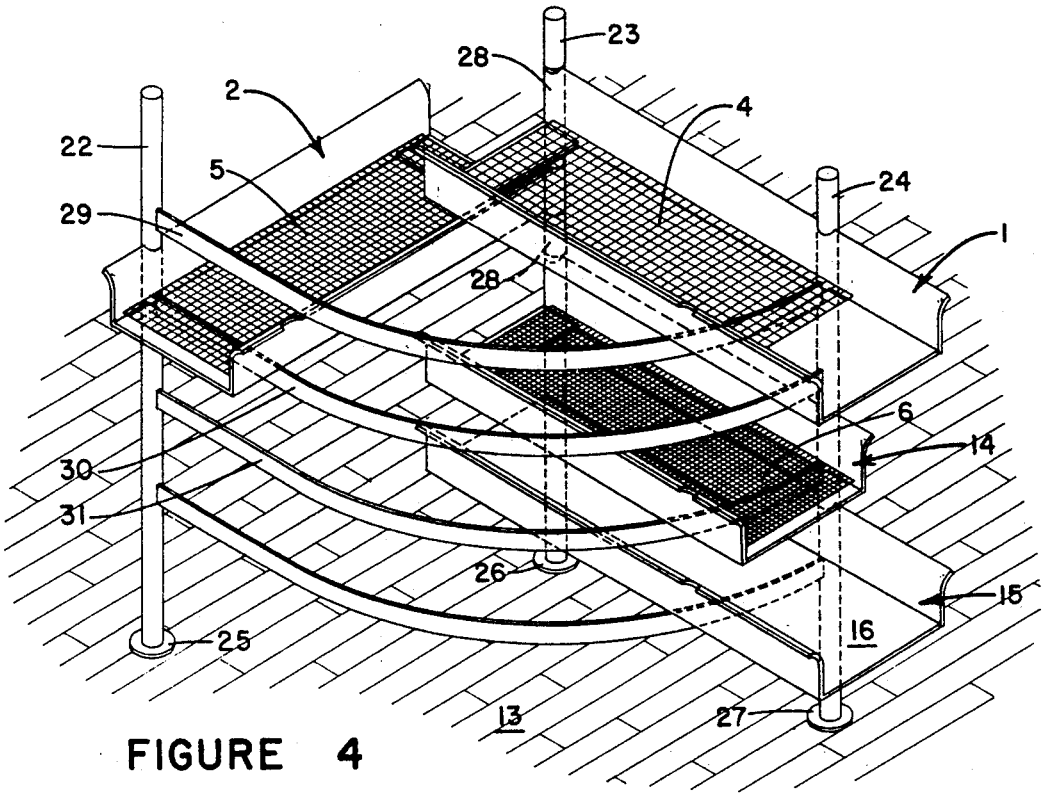
FIG. 4 is a view of a more preferred embodiment of a seafood separator device depicting means for pivoting one screen relative to the other screens.

In a more preferred embodiment shown in FIG. 4, a seafood separator device is comprised of three vertical rigid members 22, 23, 24 fixedly attached at their respective bases 25, 26, 27 to the deck 13 of a boat. Three frames 1, 2, 14 and screens 4, 5, 6 identical in structure and function to their counterparts in the alternate embodiment are employed in this embodiment, but each frame 1, 2, 14 also includes a hinge 28 attached in part to a corner of each frame 1, 2, 14 and also to one of the vertical rigid members 23. Hinge 28 allows rotational motion of each frame 1, 2, 14 in a substantially horizontal plane and is attached to frame 1, 2, 14 and vertical rigid member 23 by any appropriate method, such as by welding or bolting. Optionally, hinge 28 may be of a spring-loaded type to allow return of frames 1, 2, 14 to a rest position, as shown in FIG. 4, after it has been displaced from that rest position. As a support for the horizontal motion of the non-hinged end of frames 1, 2, 14, three substantially horizontal frame guides 29, 30, 31, one under each frame 1, 2, 14, are attached at one end to a non-hinged vertical rigid member 22 and attached at an opposite end to the remaining non-hinged vertical rigid member 24. Trash tray 15, which is similar in structure to its counterpart in the alternate embodiment, rests in a fixed position below lower frame 14, and includes an end which extends over the side of the deck 13 to allow dumping of trash and other live animals too small to be kept into the sea. In any embodiment, trash tray 15 may possibly have a larger tray bottom 16 than the screen areas of any of the frames 1, 2, 14.

In operation of this more preferred embodiment, the screens 4, 5, 6 are first positioned so that they are in vertical alignment as shown in FIG. 4, and the contents of net 51 are emptied in the same manner as in the other embodiments. As can be seen, the removal of seafood from the device is facilitated by the ability to move one screen away from the others during sorting. Once seafood is removed from the upper screen 4, upper screen 4 is moved aside so that cleaning and removal of seafood from the intermediate screen 5 may be accomplished. Likewise, to clean and remove seafood from the lower screen 6, intermediate screen 5 is temporarily displaced so that the sorting and cleaning can be completed. Washing the device after all sorting is completed is also made easier due to the movability of the individual frames 1, 2, 14.

Figure 5:
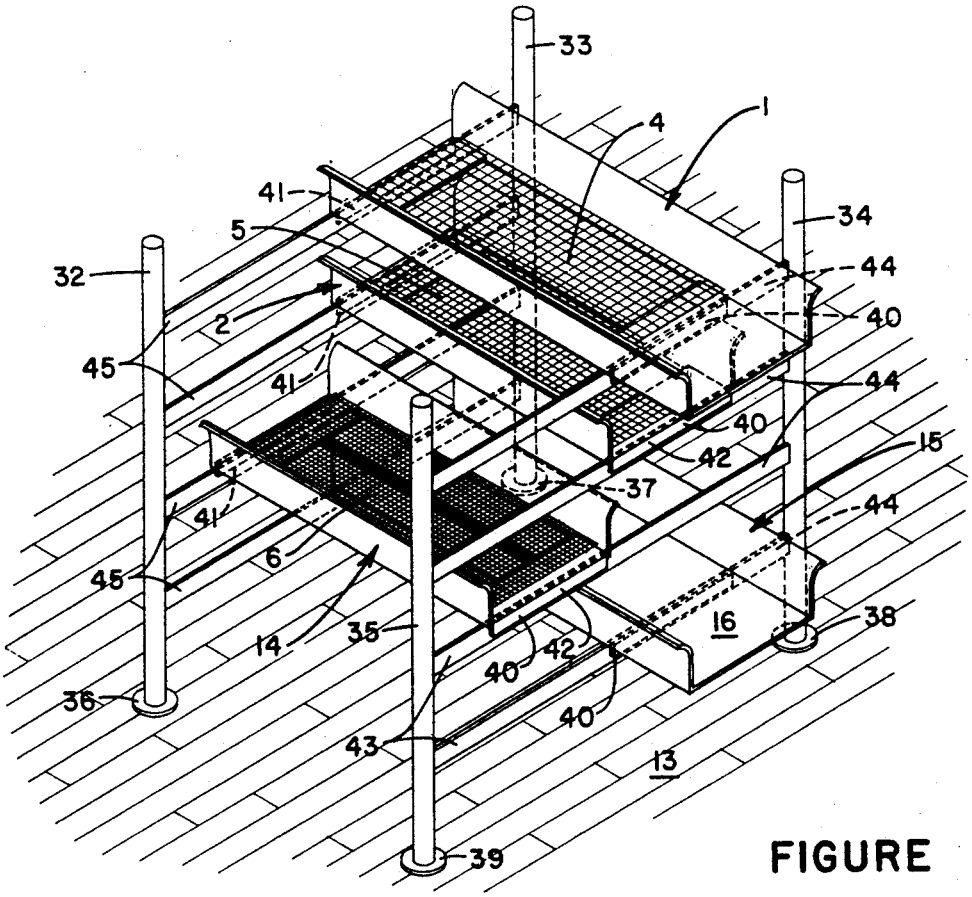
FIG. 5 is a view of the most preferred embodiment of the device also depicting moving means for sliding one screen relative to the other screens.

In a most preferred embodiment shown in FIG. 5, a seafood separator device is comprised of four vertical rigid members 32–35 fixedly attached at their respective bases 36–39 to the deck 13 of a boat. Three frames 1, 2, 14 and screens 4, 5, 6 identical in structure and function to their counterparts in the alternate embodiment shown in FIG. 3 are employed in this embodiment, but each frame 1, 2, 14 also includes a pair of guide brackets 40, 41 capable of allowing slidable movement of frame 1, 2, 14 along two parallel guide rails 44, 45 each disposed between a pair of vertical rigid members 32–35 as shown in FIG. 5. Guide brackets 40, 41 each include a flange 42 which extends over the exterior surface 43 of guide rails 44, 45, thus allowing motion of frames 1, 2, 14 only in a direction along the length of guide rails 44, 45. Frames 1, 2, 14, therefore, are not only slidable, but also removable from guide rails 44, 45. As in the previous embodiment, trash tray 15 rests in a fixed position below lower frame 14, and includes an end which extends over the side of the deck 13 to allow dumping of trash into the sea. Operation of this most preferred embodiment is depicted in FIG. 1, and is essentially the same as described in the previous embodiment.

Although the present invention has been described in terms of specific embodiments, it is anticipated that alterations and modifications thereof will no doubt become apparent to those skilled in the art. For example, it can be seen that any number of screen/frame assemblies may be used together in order to further differentiate between seafood of varying sizes as long as the grid spacing of each screen becomes progressively smaller as seafood and other products fall through each successive screen. Also, any means of displacing one screen from another in order to remove items from successively lower screens is intended to be within the scope of the claims. Furthermore, it is to be understood that any embodiment of the present invention may include a means for assisting the movement of the seafood through the screens, such as a shaker or vibrator attached to the device. It is therefore intended that the following claims be interpreted as covering all such alterations and modifications as falling within the true spirit and scope of the invention.

I claim:

1. In combination with the deck of a fishing boat, wherein a hoist assembly is used to maneuver an end of a trawling net filled with sea creatures, a seafood separator device for separating said sea creatures, comprising:

(a) a support structure attached to said deck;

(b) a plurality of substantially horizontal screening means arranged in a vertical array, each said screening means having a grid spacing and being fixedly attached to said support structure, for retaining sea creatures of predetermined sizes, wherein the grid spacing of any said screening means is larger than the grid spacing of any lower said screening means; said screening means further comprising:

(i) a rigid frame comprising a rectangular assembly of rigid frame members operatively attached to said support structure;

(ii) a screen mesh operatively attached to said frame, said screen mesh being sized to retain said sea creatures of a predetermined size;

(iii) wherein a parallel pair of said frame members have raised sides above said screen mesh sufficient in height to prevent escape of said sea creatures; and (iv) wherein each said raised side of said parallel pair of said frame members includes an outwardly flared section on top of said raised side for facilitating removal of said sea creatures from said screening means; and (c) trash discarding means fixedly attached to said support structure below a lowermost said screening means for receiving unwanted sea products passing through said array and directing said unwanted sea products back into the sea alive; wherein said trash discarding means comprises a flat, close-bottomed tray having an open end extending over the surface of the sea and at least two parallel raised sides.

2. In combination with the deck of a fishing boat, wherein a hoist assembly is used to maneuver an end of a trawling net filled with sea creatures, a seafood separator device for separating said sea creatures, comprising:

(a) a support structure attached to said deck;

(b) a plurality of substantially horizontal screening means arranged in a vertical array and operatively attached to said support structure for retaining sea creatures of predetermined sizes, wherein each said screening means includes a grid spacing and wherein the grid spacing of any said screening means is smaller than the grid spacing of any higher said screening means; each said screening means further comprising moving means operatively disposed between said support structure and said screening means for allowing slidable motion of said screening means relative to said support structure or to any other said screening means; and (c) trash discarding means operatively attached to said support structure below a lowermost said screening means for receiving unwanted sea products passing through said array and directing said sea products back into the sea alive;

wherein said support structure comprises first, second and third rigid vertical support members operatively attached to said deck, said first and second support members having a plurality of horizontal guide rails fixedly attached therebetween, said guide rails being equal in number to said plurality of said screening means and positioned in a manner to slidably support a front end of said screening means; and wherein said moving means comprises a hinge operatively connected between a rear end of each of said screening means and said third vertical support member to allow horizontal pivoting of each said screening means.

3. A separator according to claim 2, wherein each of said screening means comprises:

(i) a rigid frame in slidably communication with said support structure; and (ii) a screen mesh operatively attached to said frame, said screen mesh being capable of retaining said sea creatures of a predetermined size.

4. A separator according to claim 3, wherein said rigid frame comprises a rectangular assembly of rigid frame members in slidably communication with said support structure, wherein at least two of said frame members have raised sides above said screen mesh for preventing escape of said sea creatures.

5. A separator according to claim 4, wherein each of said raised sides of said frame members further comprise an outwardly flared section.

6. A separator according to claim 2, wherein said trash discarding means comprises a close-bottomed tray having at least two raised sides and at least one open end for allowing water and said unwanted sea products to be returned to said sea alive.

7. In combination with the deck of a fishing boat, wherein a hoist assembly is used to maneuver an end of a trawling net filled with sea creatures, a seafood separator device for separating said sea creatures, comprising:

(a) a support structure attached to said deck;

(b) a plurality of substantially horizontal screening means arranged in a vertical array and operatively attached to said support structure for retaining sea creatures of predetermined sizes, wherein each said screening means includes a grid spacing and wherein the grid spacing of any said screening means is smaller than the grid spacing of any higher said screening means; each said screening means further comprising:

(i) a rigid frame comprising a rectangular assembly of rigid frame members;

(ii) a screen mesh operatively attached to said frame, said screen mesh being sized to retain said sea creatures of a predetermined size;

(iii) wherein a parallel pair of said frame members have raised sides above said screen mesh sufficient in height to prevent escape of said sea creatures; and (iv) wherein each said raised side of said parallel pair of said frame members includes an outwardly flared section on top of said raised side for facilitating removal of said sea creatures from said screening means; and (v) moving means operatively disposed between said support structure and said screening means for allowing slidable motion of said screening means relative to said support structure or to any other said screening means; and (c) trash discarding means operatively attached to said support structure below a lowermost said screening means for receiving unwanted sea products passing through said array and directing said unwanted sea products back into the sea alive, wherein said trash discarding means comprises a flat, close-bottomed tray having an open end extending over the surface of the sea and at least two parallel raised sides; and wherein said support structure comprises first, second, third and fourth rigid vertical support members operatively attached to said deck, said first and second support members having a first set of horizontal guide rails fixedly attached therebetween, and said third and fourth support members having a second set of horizontal guide rails fixedly attached therebetween; said first and second set of guide rails each having a number of horizontal guide rails equal to said plurality of said screening means, and wherein each corresponding pair of guide rails from each said set is positioned in a manner to slidably support any said screening means.

8. In a fishing boat using a trawling net, a method of separating sea creatures caught in a net, comprising the steps of:

(a) retrieving an end of a net filled with sea creatures using a hoist and raising said end of said net over the deck of a boat;

(b) emptying said net immediately into a multi-level separating means for separating seafood of predetermined sizes into groups arranged in a vertical array, said separating means comprising a plurality of screens wherein a grid spacing of each screen is smaller than the grid spacing of any higher screen, and wherein each said screen is movable relative to any other said screen;

(c) manipulating said sea creatures to facilitate their movement to the lowest screen capable of retaining said creatures;

(d) sequentially moving each said screen away from any other said screen in order to remove desired sea creatures from said separating means for later processing; and (e) collecting undesirable said sea creatures in a flat, close-bottomed tray beneath said separation means, said tray having an open end extending over the surface of the sea, and directing said undesirable sea creatures through said open end back to the sea alive.

9. A method according to claim 8, wherein said net is emptied into a hopper positioned above said separating means, and further comprising the step of utilizing said hopper in order to regulate the amount of sea creatures emptied into said separating means.

* * * * *